United States Patent [19]

Nakatani et al.

[11] Patent Number: 4,780,301

[45] Date of Patent: Oct. 25, 1988

[54] PROCESS FOR PRODUCING CARBON FIBER

[75] Inventors: Munetsugu Nakatani; Toha Kobayashi; Yoshitaka Imai; Nobuyuki Yamamoto; Susumu Sasaki, all of Ohtake, Japan

[73] Assignee: Mitsubishi Rayon Co., Ltd., Tokyo, Japan

[21] Appl. No.: 66,629

[22] PCT Filed: Oct. 8, 1986

[86] PCT No.: PCT/JP86/00512

§ 371 Date: Jun. 4, 1987

§ 102(e) Date: Jun. 4, 1987

[87] PCT Pub. No.: WO87/02391

PCT Pub. Date: Apr. 23, 1987

[30] Foreign Application Priority Data

| | | | |
|---|---|---|---|
| Oct. 9, 1985 | [JP] | Japan | 60-225773 |
| Nov. 11, 1985 | [JP] | Japan | 60-252202 |
| Mar. 13, 1986 | [JP] | Japan | 61-53597 |
| Apr. 25, 1986 | [JP] | Japan | 61-94785 |

[51] Int. Cl.[4] ..... D01F 9/22

[52] U.S. Cl. ..... 423/447.4; 423/447.6; 423/447.8

[58] Field of Search ..... 423/447.1, 447.2, 447.4, 423/447.6, 447.8

[56] References Cited

U.S. PATENT DOCUMENTS

| | | | |
|---|---|---|---|
| 3,179,605 | 4/1965 | Ohsol | 423/447.8 |
| 3,567,380 | 3/1971 | Townsend | 423/447.8 |
| 3,764,662 | 10/1973 | Roberts, Jr. | 423/447.8 |
| 4,609,540 | 9/1986 | Izumi et al. | 423/447.4 |
| 4,610,860 | 9/1986 | Mullen | 423/447.4 |
| 4,671,950 | 6/1987 | Ogawa et al. | 423/447.1 |

FOREIGN PATENT DOCUMENTS

| | | | |
|---|---|---|---|
| 51-6244 | 2/1976 | Japan . | |
| 57-16921 | 1/1982 | Japan . | |
| 57-25419 | 2/1982 | Japan . | |
| 58-144128 | 8/1982 | Japan | 423/447.1 |
| 58-136834 | 3/1983 | Japan . | |
| 59-137512 | 8/1984 | Japan . | |
| 59-150116 | 8/1984 | Japan . | |
| 60-151317 | 8/1985 | Japan . | |

*Primary Examiner*—John Doll
*Assistant Examiner*—Wayne A. Langel
*Attorney, Agent, or Firm*—Oblon, Fisher, Spivak, McClelland & Maier

[57] ABSTRACT

The invention relates to a process for producing carbon fibers which comprises a continuous flame-resisting treatment of acrylic fibers in bundle form containing at least 90% by weight of acrylonitrile in an oxidizing atmosphere at temperatures of 250° to 350° C. by using a plurality of flame-resisting furnace different in heat treatment temperature under such conditions that the fiber density $\rho n$ after each stage of flame-resisting treatment may be maintained on the level defined by a specific conditional expression and so that the fiber density $\rho k$ after completion of the flame-resisting treatment may be from 1.34 to 1.40 g/ml, and successively are subjected to carbonizing treatment in an inert atmosphere.

10 Claims, 2 Drawing Sheets

PROCESS FOR PRODUCING CARBON FIBER

TECHNICAL FIELD

The present invention relates to a multistage flame-resisting treatment and carbonization of acrylic fibers in tow form, whereby it is possible to produce carbon fibers in tow form which have properties of high tenacity and high elasticity and whose monofilaments exhibit superior homogeneity said fiber having less yarn defects including nap, etc.

BACKGROUND ART

As is known generally, the usual process for producing carbon fibers is basically divided into a of flame-resisting step wherein acrylic fibers are subjected to heat treatment in an oxidizing atmosphere and a carbonization step where fibers from the flame-resisting treatment are subjected to heat treatment in an inert atmosphere. The step of imparting flame-resistance to acrylic fibers is practiced in an oxidizing atmosphere at temperatures of 200° to 300° C. over a period generally of 2 to 4 hours. This flame-resisting step requires 90% or more of the total time required by the process for producing carbon fibers. Accordingly it is apparent that reduction in carbon fiber production costs can be achieved by in shortening the time required for this flame-resisting reaction.

One of the methods for shortening the flame-resisting step is to raise the temperature of the treatment step as disclosed in Japanese Patent Publication No. 35938/72. However, since the flame-resisting reaction is exothermic as shown in Textile Res. J., 30, 882–896 (1960) this method when adopted may cause a vigorous uncontrollable reaction, which the inflammation of the acrylic fibers. Even if the inflammation is not induced, the acrylic fibers treated by this method will have flame-resisting structure on the peripheral portion of each filament, but will have insufficient flame-resisting structure in the inner portions thereof, thus turning into flame-resistant fibers of nonuniform flame-resisting structure. Such flame-resisting fibers in the later carbonization step will develop the undesirable phenomena known as napping and fiber break. This makes it difficult to effectively carbonize the fibers making it difficult to form high-performance carbon fibers. Japanese Patent Publication No. 25487/76 discloses a method which largely obviates these difficulties, and reduces the time for the flame-resisting treatment of the acrylic fibers to 5–30 minutes. This method comprises subjecting acrylic fibers to flame-resisting treatment under such conditions that the heat treatment time until the equilibrium moisture content of the acrylic fibers reaches 4% may be from 5 to 20 minutes, followed by carbonizing the fibers at a temperature of at least 1000° C. However, the flame-resistance fibers having an equilibrium moisture content of 4%, as is evident from a number of literature references. These films exhibit an unsatisfactory flame-resistant structure and the cross section of each filament shown an outstanding double structure. Such flame-resisting fibers undergo pyrolysis in the later step of carbonization and micro-voids are formed in the resulting fibers. Hence it is difficult to convert these fibers into high-tenacity carbon fibers having a tensile strength of 400 kg/mm$^2$ or more.

In this way, uncontrollable reactions occur during the flame resisting step and nonuniform flame-resisting reactions of acrylic fibers occur with the result that the fibers experience an increase in the number of acrylic monofilaments in a fiber a tow. Japanese Patent Application Laid-Open No. 163729/83 discloses an effective method for preparing A flame-resistance tow constructed of a large number of acrylic monofilaments. This method comprises heating acrylic tows, each constructed of 1000 to 30,000 filaments of 0.5 to 1.5 deniers in monofilament size in a flame-resisting oven at temperatures of 200° to 260° C. to convert the filaments into incompletely flame-resistant filaments having an oxygen content of 3 to 7%, thus preventing the filaments from fusing together during the later flame-resisting treatments of higher degrees) and treating the filaments under high-temperature flame-resisting conditions to convert the filaments into completely flame-resisting filaments having an oxygen content of at least 9.5%, followed by carbonizing the filaments. However, in this method, while napping or breaking of filaments does not occur, the conditions of the treatment for converting the incompletely flame-resistant filaments into completely flame-resistant filaments are harsh. Hence micro-voids are liable to develop in each filament. Moreover the oxygen content in the incompletely flame-resistant filaments is at least as high as 9.5%, and the filaments have a crosslinked structure caused by oxygen which develops therein to a high degree, so that it is impossible to effectively stretch the filaments to enhance the performance characteristics of carbon fibers obtained in the carbonization step and thus the tensile strength of the product carbon fibers is up to about 350 kg/mm$^2$.

In recent years, carbon-fiber reinforced composites have been in extensive use for sporting, astronautical, industrial, and other applications and the expansion of their consumption has been remarkable. In response to such circumstances, significant effort is being made to improve the performance characteristics of carbon fibers.

With regard to the elastic modulus of such fibers, it was 20 ton/nm$^2$ 10 years ago, and improved to standard values of 23 to 24 ton/mm$^2$ several years ago, and lately attempts have been made to prepare carbon fibers having an elastic modulus of about 30 ton/mm$^2$. It is possible that such carbon fibers will be dominant in the future.

However, if improvement of the elastic modulus of carbon fibers is to be achieved while the strength of the fibers is kept constant, a decrease in the elongation of the fibers will be brought about, as a matter of course, and composites reinforced with such carbon fibers will be brittle.

Accordingly, there is an intense demand for carbon fibers of high elasticity and high elongation, that is, carbon fibers having high elongation and high strength at the same time.

The conventional method of improving the elastic modulus has been to raise the carbonization temperature, i.e. the temperature of the final heat treatment. This method, however, has the drawback that, as the elastic modulus is increased, the strength and consequently the elongation decrease. For instance, a carbonization temperature of about 1800° C. is necessary in order to maintain an elastic modulus of 28 ton/mm$^2$, but this temperature results in a strength at least 100 kg/mm$^2$ lower than the value resulting from a carbonization temperature of 1300° C.; thus a high strength cannot be achieved at all. Such a decrease in the strength with an increase in the carbonization temperature corresponds well with a decrease in the density. This is assumed to be caused by the development of micro-voids, which will bring about a decrease in the strength, in the fibers during elevation of the carbonization temperature. When acrylic tows each having a whole filament size of 1000 to 20,000 denier after flame-resisting treatment are subjected to a carbonizing treatment, it is also impossible to produce carbon fibers tows which have high strength and high elongation from such tows, that napping or filament breaking takes place frequently in the carbonization step. The causes of such deficiencies are exemplified by significant uneveness of the flame-resisting degree throughout the monofilaments which make up the tow, high unevenness in the longitudinal direction of each monofilament subjected to flame-resisting treatment, and minute flaws present in each monofilament itself subjected to a flame-resisting treatment.

As described above, presently that no technique is known by which acrylic fibers in tow form, each tow consisting of as great 1000 to 15,000 monofilaments, particularly a precursor consisting of such tows arranged in parallel in sheet form, can be subjected to a high-speed flame-resisting treatment for a period of up to 60 minutes and to a stretching treatment which enhances the performance characteristics of the carbon fibers in the subsequent carbonization step.

When fibers of high elasticity are produced, normally the carbonizing treatment is carried out at high temperatures, but it is extremely difficult using this method to obtain carbon fibers of high strength and high elongation. For example, such carbon fibers have the drawback that their tensile strength significantly varies. The fibers are obtained by subjecting flame-resistant fibers of 1.37 g/ml in density to treatment under tension in an inert atmosphere at a temperature of 200° to 800° C. and then heat-treating the resulting fibers in an inert atmosphere at a temperature of 1300° to 1800° C. According to the present study, it is believed that there is a problem in the inter-filament and filament lengthwise unevenness of flame-resisting degree. When the conventional flame-resisting method is employed, however, it is difficult to reduce the unevenness of the flame-resisting degree.

In one known method of imparting flame resistance to acrylic fibers, the treatment temperature is increased, which result in increasing the gradient of the temperature rise in the earlier stage of the flame-resisting step and decreasing the gradient of the temperature rise in the latter half of the step (see Japanese Patent Publication No. 35938/72). However, in this method fusion or agglutination occurs frequently among filaments. Further, a vigorous uncontrollable reaction occurs and inflammation is likely to result. In another method, the gradient of the temperature rise decreases in the earlier stage of the flame-resisting step and increases in the latter half of the step (see Japanese Patent Application Laid-Open No. 163729/83). In this method, the occurrence limited fusion or agglutination among the filaments occurs but the flame-resisting reaction proceeds rapidly in the latter half of the treatment, thereby increasing the interfilament and filament axis directional unevenness of the flame-resisting degree and frequently causing napping and filament breaking. In addition, the step passableness of this method is extremely inferior and it is difficult for this technique to provide high-performance carbon fibers.

With regard to carbonization a method is known in which fibers previously subjected to flame-resisting treatment are treated at a temperature of 250° to 600° C., then at a temperature of 400° to 800° C., and finally at a temperature of 800° to 1300° C. (see Japanese Patent Application Laid-Open No. 150116/84). However. carbon fibers having satisfactory performance characteristics are difficult to obtain by this method.

In the study leading to the present invention, the following has been discovered:

(i) In the prior art, the permeation of oxygen into acrylic monofilaments is retarded because of the inadequate rate of oxygen diffusion into the interstices between the monofilaments in tow form.

(ii) As a consequence, it is necessary that the density of the flame-resistant fibers which are to be fed to the carbonization step, should be increased to 1.40 g/ml or more, thus causing such undesirable properties as described above.

(iii) As a consequence, flame-resisting conditions are chosen so as to increase the rate of oxygen diffusion into tows of the acrylic fibers, which substantially improves upon the properties of the fibers and carbon fibers exhibiting extremely-high performance can be produced from the flame-resisting fibers obtained in this way.

SUMMARY OF THE INVENTION

The substance of the invention is that when acrylic fibers in bundle form containing at least 90% by weight of acrylonitrile are continuously subjected to flame-resisting treatment in an oxidizing atmosphere at temperatures of 200° to 350° C. by using a plurality of flame-resisting furnaces each at a different treatment temperature, this treatment is carried out under such conditions that the fiber density $\rho_n$ after each stage of the flame-resisting treatment may be maintained on the level defined by the following equation (1). The fiber density $\rho_k$ after completion of the flame-resisting treatment may range from 1.34 to 1.40 g/ml, and the fibers successively are subjected to a carbonizing treatment in an inert atmosphere under the conditions $$(\rho_0 - 0.01) + (\rho_k - \rho_0)\frac{\sum_{n=1}^{n} t_n}{\sum_{n=1}^{k} t_n} \leqq \rho_n \leqq (\rho_0 + 0.01) + (\rho_k - \rho_0)\frac{\sum_{n=1}^{n} t_n}{\sum_{n=1}^{k} t_n} \quad (1)$$

wherein, $\rho_n$ is the density (g/ml) of the fibers after the n-th treatment stage, $\rho_o$ is the density (g/ml) of the feedstock acrylic fibers, $\rho_k$ is the density of the fibers after completion of the flame-resisting treatment and is a value ranging from 1.34 to 1.40 g/ml, $t_n$ is the period of n-th stage of flame-resisting treatment, and k is the number of flame-resisting treatment stages.

BRIEF DESCRIPTION OF DRAWINGS

The accompanying drawings are explained below.

In FIG. 1, curve A is the case of a high-temperature treatment, curve B is the case of a low-temperature treatment followed by a high-temperature treatment, and curve C is the case of treatment according to the process of the invention.

In FIG. 3, number 4 shows the mode in the high-temperature carbonization heat treatment method of the prior art, numbers 5 and 6 represent modes of the present inventive process, and members 7 to 9, given for comparison, represent high-temperature carbonizing treatment methods outside the range of the invention.

BEST MODE FOR CARRYING OUT THE INVENTION

Figure 1:
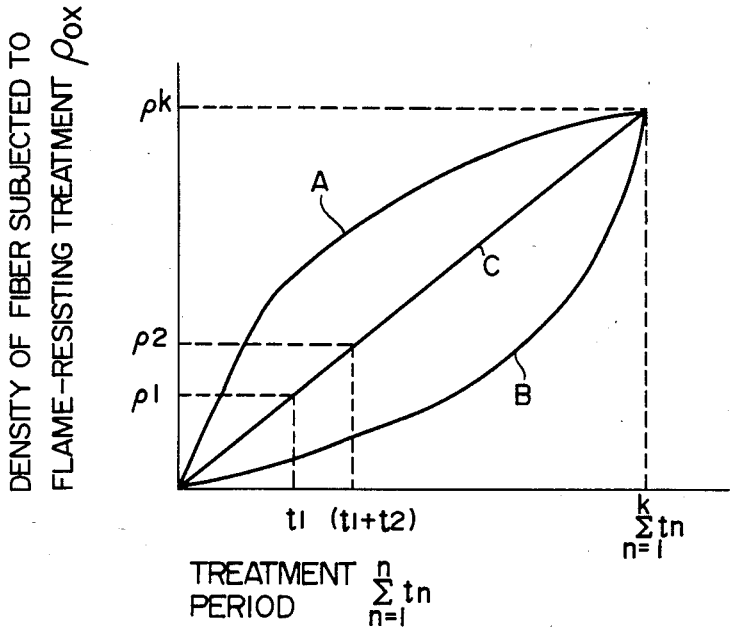
FIG. 1 is a graph showing the relation between the density of flame-resisted fibers and the period of flame-resisting treatment, for the purpose of explaining the treatment method of the present invention.

The polymer from which the acrylic fibers of the invention are formed is a copolymer of 90% by weight or more of acrylonitrile and 10% by weight or less of other copolymerizable vinyl monomer(s). This polymer can be produced by various methods including solution polymerization, suspension polymerization emulsion polymerization, and the like. It is desired that such copolymers have a reduced viscosity ranging from 1.0 to 10.0.

Fibers formed from a polymer containing less than 90% by weight of acrylonitrile units have low flame-resisting reaction activity. Hence, when such fibers are used, the temperature at which the flame-resisting reaction is initiated needs to be raised and once the flame-resisting reaction is initiated, a vigorous uncontrollable reaction is liable to occur on the contrary. The polymer preferably contains 95% by weight or more of polymerized acrylonitrile units.

The other vinyl monomer copolymerized with acrylonitrile is a constituent which accelerates the flame-resisting reaction of the acrylic fibers and contributes to reduction in the flame-resisting reaction period. Such usuable monomers include, for example, hydroxyethylacrylonitrile, methyl vinyl ketone, methyl methacrylate, acrylic acid, methacrylic acid, itaconic acid, and t-butyl methacrylate. The total amount of these constituents copolymerized is desirably up to 10%, preferably up to 5%, by weight.

The above defined acrylonitrile-based polymer is normally spun by a wet spinning method or a dry-wet spinning method to form tows of acrylic fibers of desirably 0.3 to 1.5 deniers in monofilament size, each tow having a whole fiber size of 1000 to 20,000. Fibers of less than 0.3 denier in monofilament size are undesirable since their strength is insufficient for use as feedstock fibers to produce carbon fibers. On the contrary when the size exceeds 1.5 deniers, tendency is observed in which the rate of oxygen diffusion into the monofilament in the flame-resisting step is diminished, which makes it difficult to prepare uniformly flame-resistant fibers.

On the other hand, tows of less than 1000 deniers in the whole fiber size of each tow have good passableness through the flame-resisting step but exhibit radpidly-lowered productivity for flame-resisting fibers. When the whole fiber size of each tow, on the contrary, exceeds 20,000 deniers, the diffusion of oxygen into the inner portion of the acrylic tow will be retarded in the flame-resisting step and this tends to develop a difference in flame resistance between outer-side filaments and inner-side filaments in each tow.

The properties which are necessary for the fibers subjected to a flame-resisting treatment to have from which high-performance carbon fibers can be produced include that the nap of the fibers should not be developed, 2% or more, preferably 5% or more, stretch should be possible in the initial stage of the carbonization step, and the amount of tar formed should be limited. The tows of flame-resisting fibers provided with such properties should exhibit no large difference in the density of filaments subjected to flame-resisting treatment between the filaments located in the outer side of the tow of 1000–20,000 deniers and the filaments located in the central part of the tow. The degree of flame-resistant in each treated filament should be uniform as far as possible.

In order to prepare tows of flame-resisting fibers, provided with such properties as stated above by an oxidizing treatment, of 1000- to 20,000-denier tows of acrylic fibers, it is necessary that the condition defined by equation (1) supra should be satisfied by the fiber density which indicates the degree to which the flame resistance of the fibers is improved by passing through the n-th one of a series of flame-resisting furnaces.

When $\rho_n$ is larger than the value of the right side of equation (1), in the first half of the flame-resisting step, a high-temperature treatment becomes necessary in order to increase the fiber density in the initial stage as shown by line A of FIG. 1 appended. Accordingly, inflammation or fusion of filaments is likely to occur because of an uncontrollable run of reaction and it becomes difficult to shorten the flame-resisting step. In order to avoid the vigorous, uncontrollable reaction accompanying the high-temperature treatment, as practised in the past, it has been necessary to treat fibers at relatively low temperatures in the first half of the flame-resisting step and rapidly increase the density of the treated fibers, as shown by line B of FIG. 1, in the latter half step, thereby substantially limiting uncontrollable runs of reaction. In consequence, micro-voids are formed in each resulting flame-resisting filament and the filaments exhibit large differences in the degree of flame-resistant between the outer and the inner portions of each filament. It can be seen that such fibers subjected for a short time to flame-resisting treatment do not exhibit stretchability at all in the later carbonizing treatment step and is liable to develop nap.

In the present invention, as opposed to this, the flame-resisting reaction, when the flame-resisting treatment conditions are such that $\rho_n$ is in the range defined by equation (1), the reaction proceeds such that a nearly linear relation exists between the density $\rho_{ox}$ of the fibers subjected to the flame-resisting treatment and the period $$\sum_{n=1}^{n} t_n$$

of the flame-resisting treatment as shown by line C in FIG. 1. Even when the total period $$\sum_{n=1}^{K} t_n$$

of flame-resisting treatment is limited to 60 minutes or less, the difference between $\rho_{ox}$ of the exterior of the filaments of each tow resulting from the flame-resisting treatment and $\rho_{ox}$ of the interior of the filaments of each tow can be reduced in the extreme. Moreover, it can be seen that uniform flame-resistant in each filament can be achieved effectively and the thus treated tows have the slightest inter-filament fusion or agglutination. The value of $\rho_o$ is normally about 1.18, and $\rho_k$ in the present invention needs to lie in the range of 1.34 to 1.40, preferably 1.35 to 1.38. Flame-resistant fibers having $\rho_k$ values less than 1.34 undergo rapid pyrolysis and tend to develop nap, in the carbonization step, and hence cannot be converted into carbon fibers having good performance characteristics. On the contrary, those fibers having $\rho_k$ values exceeding 1.40 only with difficulty to provide high-performance carbon fibers having tensile strengths of at least 400 kg/mm$^2$.

Against this, the present inventive fibers subjected to flame-resisting treatment, having $\rho_k$ values ranging from 1.35 to 1.40, can be stretched by as much as 3 to 25% without undergoing abnormal pyrolysis in the carbonization step, thereby providing carbon fibers having excellent performance characteristics. The invention produces distinguished effect when the flame-resisting treatment period is up to 90 minutes, particularly in the range of 20 to 60 minutes.

The number of stages in the multistage flame-resisting furnace used in the invention is at least 3, perferably 3 to 6. Too large a number of these stages is undesirable, since such a furnace is uneconomical and much restricted with respect to the installation thereof and has adverse effects on the workability.

The multistage flame-resisting method of the invention is effective in baking single or plural acrylic tows of 0.3 to 1.5 deniers in monofilament size and 1000 to 20,000 deniers in each tow size, particularly effective in baking dozens to hundreds of acrylic tows arranged in parallel and in sheet form. When acrylic tows arranged in sheet form are baked, the objectives of the present invention can be fully achieved by spacing the tows so suitably that the diffusion of oxygen into each tow may not be hindered and by controlling the rate of heating so that the level of flame-resistant may satisfy equation (1). Fibers obtained a flame-resisting treatment in this way can be baked in the carbonization step while being stretched sufficiently and can be converted into carbon fibers having excellent performance characteristics. Additionally, the period of the flame-resisting treatment can be reduced notably by this manner of baking in comparison to the conventional method of treatment.

In the invention, it is desirable to conduct the flame-resisting treatment, while stretching the fibers to a stretch percentage of up to 30% until the fiber density reaches 1.22 g/ml and then to a total stretch percentage of up to 50% until the fiber density reaches 1.26 g/ml.

Fibers subjected to flame-resisting treatment which are convertible into high-performance carbon fibers are those which have a highly-oriented structure which tend to form graphite net planes. Before the acrylic fiber density, which is usually about 1.18 g/ml, reaches 1.22 g/ml, about 50% stretch of acrylic fibers is possible, but when the stretch percentage exceeds 30%, the unevenness of the fibers resulting from flame-resisting treatment may increase and simultaneously yarn defects may develop. The growth of graphite crystal structure in the carbonization step is facilitated and highly oriented defect-free carbon fibers can be obtained, by the stretch at a draw to give a total stretch percentage of up to 50% until the fiber density reaches 1.26 g/ml.

It may be noted that the flame-resisting treatment in the region where the fiber density exceeds 1.26 g/ml needs to be conducted under such conditions that substantial stretching of the fibers may not take place. If the substantial stretching of the fibers takes place in this region, numerous micro-voids will to form in the carbon fibers and the performance characteristics of these fibers will deteriorate. Shrinkage of the fibers in this step induces disorder in the fine structure of the fibers subjected to flame-resisting treatment and decreases the strength of the resulting carbon fibers.

An example of method for stretching the fibers involves bringing the fibers into contact with a number of rotating rolls, the speeds of which are increased for a while until the density reaches 1.26 g/ml and thereafter are maintained constant.

In the carbonization step of to the present invention, the fibers of 1.34 to 1.40 g/ml density subjected to flame-resisting treatment are heat-treated in an inert atmosphere at a starting temperature of 300°±50° C., a final temperature of 450°±50° C., and heating rate of 50° to 300° C./min.

When the starting temperature of the heat treatment is below 250° C., the tarry component formed in the fibers which are subjected to the flame-resisting treatment is difficult to remove effectively. When the starting temperature exceeds 350° C., rapid pyrolysis of the flame-resisting fibers followed by frequent filament breaking or napping will take place all of this deteriorates the step passableness and tending to provide fibers which contain numerous micro-voids, thereby making it impossible to produce high-performance carbon fibers. The final heat treatment temperature in this step needs to be 450°±50° C. When the final temperature is below 400° C., the tarry component which forms may remain in the fibers. When the final temperature exceeds 500° C., performance the characteristics of the resulting carbon fibers rapidly deteriorate.

The rate of heating needs to be from 50° to 300° C./min within the above temperature range. When the rate of heating exceeds 300° C./min, the performance characteristics of the resulting carbon fibers rapidly deteriorate. When the rate of heating is less than 50° C./min, it becomes necessary to increase the furnace length markedly, this being economically unfavorable.

In the next step of the process the fibers are heat-treated in an inert atmosphere at a temperature of 400° to 800° C.

When this treatment temperature is below 400° C. or higher than 800° C., it is impossible to produce carbon fibers which have excellent strength and elastic modulus. The treatment period is desirably up to 3 minutes, preferably in the range of 0.1 to 1 minute.

As will be shown in Examples, a treatment period exceeding 3 minutes is undesirable since deterioration is observed in the performance characteristics of the resulting carbon fibers.

Figure 2:
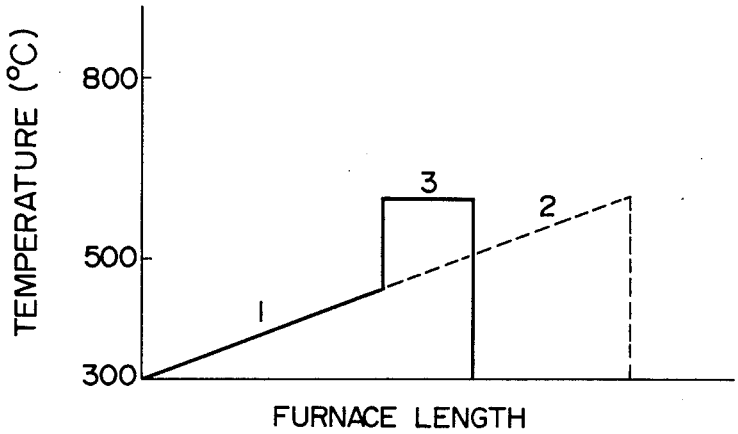
FIG. 2 is a graph showing temperature profiles during low-temperature carbonization, with furnace length as abscissa and temperature as the ordinate . Straight lines 1 and 3 show such the temperature profile in the invention.

The above stated low-temperature carbonization treatment can be carried out with ease by using, for example, a 300°±50° C. to 450° C.±50° C. increasing temperature furnace and a 400° to 800° C. constant temperature furnace. The relation between the treatment temperature and the furnace length in this case is explained with reference to FIG. 2. FIG. 2 is a graph showing the temperature profiles of low-temperature carbonizing treatments, with abscissa as furnace length and the ordinate is temperature. Line 1 shows the profile in the case of the heat treatment in which the starting temperature is 300° C. and the final temperature is 450° C. while line 3 shows the profile in case of the heat treatment at a constant temperature of 600° C. Dotted line 2 shows the profile in case where the heat treatment occurs at the same rate of temperature increase as in the case of line 1, which is in the temperature range of 450° to 600° C. The treatment which is conducted as shown by straight line 1 and dotted line 2 requires a markedly larger furnace length than does the treatment which is conducted as shown by lines 1 and 3. In the former case, high-performance carbon fibers cannot be obtained.

For the purpose of producing carbon fibers having a high elastic modulus, the following way of stretching is preferable. That is, the fibers resulting from the flame-resisting treatment according to the above described method are treated under tension in an inert atmosphere at temperatures of 300° to 500° C.

This operation step is necessary to convert the flame-resistant fibers into a carbon fiber structure having excellent performance characteristics. Carbon fibers produced without this step have many yarn defects such as voids and have inferior performance characteristics.

Then, the fibers are heat-treated in an inert atmosphere at a temperature of 500° to 800° C. while being stretched at a stretch percentage of 0 to 10%.

When the fibers subjected to such a heat treatment while being stretched are fed to the carbonization step at a temperature of 1000° C. or higher, carbon fibers having an elastic modulus of 26 ton/mm$^2$ or more can be obtained without heat treatment at a high temperature of at least 2000° C., since the growth of graphite net planes is good.

The following conditions are also preferable for the purpose of producing carbon fibers having a high elastic modulus. That is, the fibers subjected to low-temperature heat treatment as stated above are heat-treated in an inert atmosphere in a high-temperature heat treating furnace where the starting temperature of the heat treatment ranges from 1000° to 1300° C., the maximum temperature of heat ranges from 1350° to 1900° C. where the maximum temperature zone is on the fiber exit side of the middle part of the furnace as shown by 5 and 6 in FIG. 3, and thus the gradient of the temperature increase is low, so that the nitrogen content of the resulting carbon fibers will be from 0.5 to 5.0% by weight. In the carbonizing treatment step, the temperature increase in the region of the rapid denitrifying reaction, which starts usually at about 1000° C., becomes steep when the starting temperature of the heat-treating the fibers exceeds 1300° C. This results in a fiber structure abundant in voids, making it difficult to produce carbon fibers having excellent performance characteristics. On the other hand, not much is gained by lowering the starting temperature of the heat treatment to less than 1000° C. since below this temperature insignificant carbonization of the fibers occurs.

In this high-temperature heat treatment step, the maximum temperature of the heat treatment ranges from 1350° to 1900° C., preferably from 1450° to 1850° C. When the maximum temperature is below 1350° C., carbon fibers having an elastic modulus of 26 to 33 ton/mm$^2$ or more cannot be obtained carbon fibers. On the other hand, when this temperature exceeds 1900° C., the tensile strength of the resulting carbon fibers decreases to a large extent below 400 kg/mm$^2$.

Figure 3:
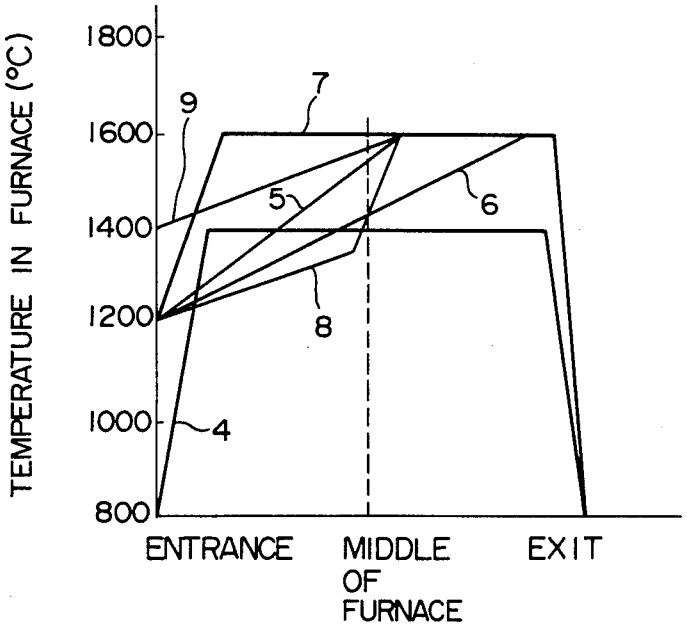
FIG. 3 shows modes of increasing the gradient of furnace temperature in the case of high-temperature heat treatments during carbonization.

When the maximum temperature zone in the high-temperature heat treating furnace is positioned on the fiber entrance side of the middle part of the furnace, the gradient of temperature increase from the starting temperature to the maximum is extremely high as shown by 7 in FIG. 3. Hence, an excessive amount of gas evolves during this temperature increase and the fiber structure is set in a state wherein numerous micro-voids are formed. Therefore, no high-strength and high-elasticity carbon fibers can be produced in this case. When a step such that the gradient of temperature rise is high, for example, as shown by 8 in FIG. 3, is involved between the initiation of high-temperature fiber treatment and the maximum temperature arrival, an excessive gas evolution is caused and high-performance carbon fibers also cannot be obtained. In the present invention, in contrast to this, a low gradient of temperature rise is applied as shown by 5 or 6 in FIG. 3. Therefore, not so much gas is evolved along with the growth of carbon net planes, unusual void formation does not take place in the coarse of raising the fiber temperature, and the action of restoring from voids is added. Thus, high-performance carbon fibers can be produced.

In the invention, it is desirable to control the temperature in the high-temperature heat treatment step so that the nitrogen content of the resulting carbon fibers may be in the range of 0.5 to 5.0% by weight. Such high-temperature treatment in this step as to give a less nitrogen content than 0.5% by weight may lower the strength of the resulting carbon fibers. On the other hand, such high-temperature treatment as to give a nitrogen content exceeding 5.0% by weight makes it difficult to grow the structure sufficiently in carbon fibers.

EFFECT OF THE INVENTION

According to the invention, it is possible to produce effectively high-performance carbon fibers of at least 450 kg/mm$^2$ tensile strength and at least 26 ton/mm$^2$ elastic modulus which are free of yarn defects and have a highly oriented graphite crystal structure, because the fibers subjected to flame-resisting treatment which have a flame-resisting degree uniform from outer side filaments to inner side filaments in each tow of the fibers as well as uniform in the filament axial direction are treated to be carbonized under specific conditions.

Having high elasticity and high strength, carbon fibers obtained according to the invention can be used for a wide variety of applications; those as primary construction materials for aircraft; sporting goods such as fishing rods and golf shafts; industrial applications to high-speed centrifuges, robots, etc., high-speed land transporting vehicle applications; and so forth.

EXAMPLES

The following examples illustrate the present invention.

In the examples, the strength and elastic modulus of strands were measured in accordance with the method of JIS R7601. The density was measured by the density gradient tube method.

EXAMPLE 1

The range of fiber density after each of the following flame-resisting treatment stages was calculated by using equation (1). That is, tows each consisting of 12,000 acrylic monofilaments of 1.18 g/ml in density and 1.3d in size are subjected to flame-resisting treatment for a treating period of 30 minutes by using a hot-air circulating type of flame-resisting furnace which has 5 different temperature stages, the 1st to 4th stages being each 8 m long and the 5th stage being 5.3 m long, so that the fiber density after completion of the flame-resisting treatment may become 1.36 g/ml. The calculated density ranges were as shown in Table 1.

Then, the respective treatment temperatures necessary to attain the above calculted ranges of fiber densities were read out from curves previously drawn by plotting fiber density vs. flame-resisting treatment period at various given temperatures. The determined temperature conditions are shown in Table 1. Under these temperature conditions, 50 said acrylic tows arranged at suitable intervals were subjected to 30 minutes' flame-resisting treatment while being stretched by substantially 10% at a feed speed of 67.8 m/hr and a take-off speed of 74.6 m/hr. This flame-resisting treatment was operated continuously for 24 hours, during which no inflammation due to an incontrollable run of reaction took place, and the flame-resisting tows obtained were free of fusion and nap, thus being satisfactory. After operation for 24 hours, fibers resulting from each stage of treatment were sampled and the density thereof was measured by using density gradient tubes. The found densities of fibers from all the stages were in the respective ranges of calculated densities as shown in Table 1.

Tows treated for flame-resisting were then carbonized in an atmosphere of nitrogen by passing them continuously through a precarbonization furnace at 600° C. and a carbonization furnace at 1400° C. In this case, the percentage of stretch in the precarbonization furnace was changed until nap developed, wherein nap did not develop at all up to 12% stretch and slight nap was observed on 14% stretch. Then, the carbonization was carried out while setting the percentage of stretch in the precarbonization furnace at 8%. The resulting carbon fibers showed napping very little and high performance characteristics such as a tensile strength of 480 kg/mm$^2$ and an elastic modulus of 24 ton/mm$^2$.

COMPARATIVE EXAMPLE 1

Flame-resisting treatment was carried out according to the procedure of Example 1 but changing temperature conditions as shown in Table 2. The flame-resisting treatment was stable without causing napping or fusion. Then, carbonizing treatment was conducted according to the procedure of Example 1, but napping occurred frequently in the precarbonization furnace and the stretch could not be performed at all. Therefore the carbonizing treatment was tried without stretch, but napping took place frequently in the carbonization furnace and the resulting carbon fibers were unworthy of evaluation. The density of fibers from each stage of flame-resisting treatment was also measured in the same manner as in Example 1. As shown in Table 2, the result was that the found densities of fibers from the 1st through 3rd stages departed from the respective ranges of calculated densities shown in Table 1.

COMPARATIVE EXAMPLE 2

In the same manner as in Example 1, flame-resisting treatment temperatures were determined which satisfy equation (1) when the treatment is conducted for 30 minutes so that the fiber density after completion of the treatment may be 1.36 g/ml, as in Example 1 but using only the 1st and 2nd stages. The calculated temperatures of the 1st and 2nd stages were 245° C. and 265° C., respectively. Flame-resisting treatment was tried at these temperatures for a treatment period of 30 minutes at a take-off speed of 74.6 m/hr, but the treatment was infeasible as tow break was caused in the 2nd stage by an incontrollable run of reaction.

TABLE 1

| Treatment stage No. | Calculated density range (g/ml) | Treatment temperature (°C.) | Found density (g/ml) |
|---|---|---|---|
| 1 | 1.2086–1.2286 | 241 | 1.2254 |
| 2 | 1.2472–1.2672 | 245 | 1.2618 |
| 3 | 1.2858–1.3058 | 253 | 1.2978 |
| 4 | 1.3244–1.3444 | 261 | 1.3307 |
| 5 | 1.3500–1.3700 | 272 | 1.3546 |

TABLE 2

| Treatment stage No. | Treatment temperature (°C.) | Found density (g/ml) |
|---|---|---|
| 1 | 223 | 1.2020 |
| 2 | 228 | 1.2250 |
| 3 | 247 | 1.2638 |
| 4 | 264 | 1.3252 |
| 5 | 278 | 1.3617 |

EXAMPLE 2

The range of fiber density after each of the following flame-resisting treatment stages was calculated by using equation (1). That is, tows each consisting of 12,000 acrylic monofilaments of 1.18 g/ml in density and 1.3d in size are subjected to flame-resisting treatment for a treating period of 45 minutes by using a hot-air circulating type of flame-resisting furnace which has 5 different temperature stages, the 1st to 4th stages being each 8 m long and the 5th stage being 5.3 m long, so that the fiber density after completion of the flame-resisting treatment may become 1.36 g/ml. The calculated density ranges were as shown in Table 3.

Then, the respective treatment temperatures necessary to attain the above calculated ranges of fiber densities were read out from curves previously drawn by plotting fiber density vs. flame-resisting treatment period at various given temperatures. The determined temperature conditions are shown in Table 3. Under these temperature conditions, 50 said acrylic tows arranged at suitable intervals were subjected to 45 minutes' flame-resisting treatment while being stretched by 20% in the 1st stage and by 8% in the 2nd stage at a take-off speed of 50 m/hr.

This flame-resisting treatment was operated continuously for 24 hours, during which no inflammation due to an incontrollable run of reaction took place, and the flame-resisting tows obtained were free of fusion and nap, thus being satisfactory. After operation for 24 hours, fibers resulting from each stage of treatment were sampled and the density thereof was measured by using density gradient tubes. The found densities of fibers from all the stages were in the respective ranges of calculated densities as shown in Table 3.

Tows treated for flame-resisting were then carbonized in an atmosphere of nitrogen by passing them continuously through a precarbonization furnace at a maximum temperature of 600° C. and a carbonization furnace at a maximum temperature of 1500° C. In this case, the percentage of stretch in the 600° C. carbonization furnace was changed until nap developed, wherein nap did not develop at all up to 20% stretch and slight nap was observed on 22% stretch. Then, the carbonization was carried out while setting the percentage of stretch in the 600° C. carbonization furnace at 8% and then giving a shrinkage of 4% at 1600° C. The resulting carbon fibers showed napping very little and excellent performance characteristics such as a tensile strength of 535 kg/mm$^2$ and an elastic modulus of 28.5 ton/mm$^2$.

TABLE 3

| Treatment stage No. | Calculated density range (g/ml) | Treatment temperature (°C.) | Found density (g/ml) |
|---|---|---|---|
| 1st Stage | 1.2086–1.2286 | 228 | 1.2233 |
| 2nd Stage | 1.2472–1.2672 | 237 | 1.2654 |
| 3rd Stage | 1.2858–1.3058 | 244 | 1.3007 |
| 4th Stage | 1.3244–1.3444 | 252 | 1.3345 |
| 5th Stage | 1.3500–1.3700 | 262 | 1.3604 |

COMPARATIVE EXAMPLE 3

Flame-resisting treatment was conducted according to the procedure of Example 2 but the temperature conditions were changed as shown in Table 4. This flame-resisting treatment was stable without causing napping or fusion. Then carbonizing treatment was conducted in the same manner as in Example 1, but napping occurred frequently in the carbonization furnace of maximum temperature 600° C. and the stretch cannot be performed at all. Also the passage through the carbonization furnace at zero percentages of stretch caused napping frequently in the furnace and the resulting carbon fibers were unworthy of evaluation.

The fiber density after each stage of flame-resisting treatment was measured according to the method of Example 2. As shown in Table 4, the results were that the densities of fibers from the 1st to 3rd stages departed from the respective calculated density ranges shown in Table 3.

TABLE 4

| Treatment stage No. | Treatment temperature (°C.) | Found density (g/ml) |
|---|---|---|
| 1st Stage | 215 | 1.1993 |
| 2nd Stage | 220 | 1.2184 |
| 3rd Stage | 232 | 1.2500 |
| 4th Stage | 255 | 1.3155 |
| 5th Stage | 270 | 1.3648 |

EXAMPLE 3

The treatment procedure of Example 2 was followed except that the fibers were 20% stretched in the 1st stage of flame-resisting treatment until the treated fiber density reached 1.22 g/ml and further 15% stretched in the 2nd stage until the fiber density reached 1.26 g/ml, thereby giving a total stretch of 38% in the flame-resisting treatment step. The obtained carbon fibers exhibited a tensile strength of 555 kg/mm$^2$ and an elastic modulus of 29.2 ton/mm$^2$.

COMPARATIVE EXAMPLE 4

The procedure of Example 2 was followed, but the fibers were 38% stretched in the 1st stage of flame-resisting treatment to a treated fiber density of 1.22 g/ml. This caused frequent napping and further break of tows in the stretch zone.

EXAMPLE 4

Multi-filament tows each consisting of 12,000 filaments of 1.5d in monofilament size were prepared from an acrylonitrile/methacrylic acid (98/2) copolymer by a dry-wet spinning process. These tows were subjected to flame-resisting treatment for a period of about 45 minutes in air having a temperature gradient of from 230° to 270° C. while being stretched to a total stretch of 20%, giving flame-resisting fibers of 1.35–1.36 g/ml in density.

The flame-resisting fibers were treated under 8% stretch in an inert atmosphere having a profile of temperature raised linearly from 300° to 500° C., then under 4% stretch in an inert atmosphere having a temperature profile with a maximum of 800° C., and in an inert atmosphere having a temperature profile with a maximum of 1600° C. without stretch. Table 5 shows performance characteristics of the thus obtained carbon fibers and conditions of the experiments.

TABLE 5

| No. | Rate of raising temperature from 300 to 500° C. (°C./min) | Treatment period at 400–800° C. (min) | Strand strength (kg/mm$^2$) | Strand elastic modulus (ton/mm$^2$) |
|---|---|---|---|---|
| 1 (Comparative) | 20 | 0.3 | 538 | 32.0 |
| 2 | 50 | 0.3 | 546 | 32.2 |
| 3 | 100 | 0.3 | 539 | 31.8 |
| 4 | 200 | 0.3 | 520 | 31.3 |
| 5 | 300 | 0.3 | 498 | 30.8 |
| 6 (Comparative) | 450 | 0.3 | 473 | 29.4 |
| 7 | 200 | 0.7 | 527 | 31.0 |
| 8 | 200 | 1.0 | 506 | 30.8 |
| 9 (Comparative) | 200 | 1.3 | 482 | 30.4 |
| 10 (Comparative) | 200 | 1.9 | 469 | 30.1 |
| 11 (Comparative) | 200 | 3.8 | 450 | 29.6 |

Nos. 1 and 6 are comparative examples different in the rate of raising temperature in the range of 300° to 500° C. and Nos. 9, 10, and 11 are comparative examples different in the treatment period at temperatures of 400° to 800° C.

EXAMPLE 5

Multifilament tows each consisting of 12,000 filaments of 1.5d in monofilament size were prepared from a polymer of 0.25 specific viscosity [ηsp] constituted of 98 wt% acrylonitrile and 2 wt% of acrylic acid by a dry-wet spinning process. These tows were arranged in sheet form wherein multifilaments were in intimate contact one with another. These tows in sheet form were subjected to flame-resisting treatment by using a flame-resisting furnace having 5 zones which were maintained under an oxidizing atmosphere by forced circulation of air and were adjusted to temperatures of 232°, 240°, 248°, 255°, and 266° C., respectively. The treatment period was 8 minutes in each of the 1st to 4th zones and 5.3 minutes in the 5th zone, amounting to 37.3 minutes. In this way, the density of fibers passed through each zone satisfied the condition of equation (1) and the fiber density after completion of the flame-resisting treatment became 1.35–1.36 g/ml. The percentage of stretch was 15% in the 1st zone, 5% in the 2nd zone, and 0% in the other zones.

The thus flame-resisted fibers were subjected to precarbonization treatment in two stages, one having a gradient of temperature raised from 300° to 500° C. and the other having a temperature of 600° C., while being stretched as shown in the following table. Thereafter, the fibers were subjected to carbonizing treatment in an inert atmosphere having a gradient of temperature raised from 1300° to 1800° C. while being shrinked by 4%. For comparison, carbon fibers were produced in the same manner except that the precarbonization was conducted in an inert atmosphere having a temperature gradient of from 300° to 700° C. Table 6 shows strand strengths and elastic moduli of the obtained carbon fibers.

TABLE 6

| No. | Precarbonizing treatment | Stretching 1st Stage | Stretching 2nd Stage | Strand strength (kg/mm²) | Strand elastic modulus (ton/mm²) |
|---|---|---|---|---|---|
| 1 | Two stages of 300–500° C. and 600° C. | 8% | 0% | 536 | 29.4 |
| 2 | Two stages of 300–500° C. and 600° C. | 8% | 2% | 524 | 29.9 |
| 3 | Two stages of 300–500° C. and 600° C. | 8% | 4% | 534 | 30.3 |
| 4 | Two stages of 300–500° C. and 600° C. | 8% | 6% | 537 | 30.9 |
| 5 (Comparative example) | One stage of 300–700° C. | 8% | | 528 | 29.2 |
| 6 (Comparative example) | One stage of 300–700° C. | 10% | | 532 | 29.5 |
| 7 (Comparative example) | One stage of 300–700° C. | 12% | | 537 | 29.7 |
| 8 (Comparative example) | One stage of 300–700° C. | 14% | | 522 | 29.9 |

It can be seen from this table that great elastic modulus increasing effect is achieved by dividing the precarbonizing treatment into two stages and distributing the stretch between the two stages in particular when the amount of stretch is large. While napping was observed in the case of single-stage treatment when the percentage of stretch was 14%, it has been revealed that in the present invention, no napping is observed even when the total percentage of stretch in the precarbonizing treatment is 14%, and higher stretch can be achieved.

EXAMPLE 6

Acrylic tows each consisting of 12,000 filament of 1.18 g/ml in density and 1.3d in monofilament size were subjected to flame-resisting treatment by using a hot-air circulating type of multistage flame-resisting furnace having 5 different temperature stages, the 1st to 4th stages being each 8 m long and the 5th stage being 5.3 m long, so that a total stretch of 20% might be achieved during a treatment period of 45 minutes and the fiber density might become 1.36 g/ml after completion of the flame-resisting treatment. Table 7 shows treatment temperatures preset in this case so that the fiber density after each stage of treatment might be in the density range calculated according to equation (1) and the fiber densities found under the above temperature conditions. It can be seen from Table 7 that the found densities after all the stages lie in the respective calculated density ranges.

Successively, tows from the above flame-resisting treatment were treated under an atmosphere of nitrogen in a heat-treating furnace having a maximum temperature of 600° C. and a temperature gradient of 200° C./min from 300° to 600° C., while being 8% stretched. Then, the tows were subjected to high-temperature treatment under the same atmosphere in a furnace of temperature profile (5 in FIG. 3) having a heat treatment starting temperature of 1200° C., a maximum treatment temperature of 1600° C. and the maximum temperature zone on the fiber exit side of the middle part of the furnace. The resulting carbon fibers exhibited a tensile strength of 545 Kg/mm² and an elastic modulus of 28.8 ton/mm², being of such considerably high performance, and the nitrogen content thereof was 2.1%.

TABLE 7

| Treatment stage No. | Calculated density range (g/ml) | Treatment temperature (°C.) | Found density (g/ml) |
|---|---|---|---|
| 1st Stage | 1.2086–1.2286 | 228 | 1.2235 |
| 2nd Stage | 1.2472–1.2672 | 237 | 1.2660 |
| 3rd Stage | 1.2858–1.3058 | 244 | 1.3024 |
| 4th Stage | 1.3244–1.3444 | 252 | 1.3348 |
| 5th Stage | 1.3500–1.3700 | 262 | 1.3598 |

EXAMPLE 7

The treatment was conducted under the same conditions as applied in Example 6 except that the maximum heat treatment temperature in the high temperature carbonization was changed to 1350° C. The obtained carbon fibers exhibited a tensile strength of 565 kg/mm², elastic modulus of 27.2 ton/mm², and nitrogen content of 4.3%.

COMPARATIVE EXAMPLE 5

The treatment was conducted under the same conditions as applied in Example 6 but using a temperature profile (7 of FIG. 3) having the maximum temperature zone on the fiber entrance side of the middle part of the furnace in the high-temperature carbonizing treatment. The obtained carbon fibers exhibited a tensile strength of 448 kg/mm² and an elastic modulus of 27.6 ton/mm², which were much lower than those of carbon fibers obtained in Example 6.

COMPARATIVE EXAMPLE 6

The treatment was conducted under the same conditions as applied in Example 6 except that the heat treatment starting temperature in the high-temperature carbonizing treatment was changed to 1400° C. (9 of FIG. 3). The obtained carbon fibers exhibited a tensile strength of 460 kg/mm$^2$ and an elastic modulus of 27.4 ton/mm$^2$, which were much lower than those of carbon fibers obtained in Example 6.

We claim:

1. A process for producing carbon fibers, comprising:

continuously subjecting acrylic fibers in bundle form containing at least 90% by weight of acrylonitrile to a flame-resisting treatment in an oxidizing atmosphere at temperatures of 200° to 350° C. in a plurality of flame-resisting furnaces each at a different treatment temperature, said treatment being conducted under such conditions that the fiber density $\rho_n$ after each stage of flame-resisting treatment may be maintained on the level defined by equation (1) and so that the fiber density $\rho_k$ after completion of the flame-resisting treatment may range from 1.34–1.40 g/ml, $$(\rho_0 - 0.01) + (\rho_k - \rho_0)\frac{\sum_{n=1}^{n} t_n}{\sum_{n=1}^{k} t_n} \leqq \rho_n \leqq (\rho_0 + 0.01) + (\rho_k - \rho_0)\frac{\sum_{n=1}^{n} t_n}{\sum_{n=1}^{k} t_n} \quad (1)$$

wherein, $\rho_n$ is a density (g/ml) of the fibers after the n-th treatment stage, $\rho_0$ is a density (g/ml) of the feedstock acrylic fibers, $\rho_k$ is a density of the fibers after completion of the flame-resisting treatment and is a value ranging from 1.34–1.40 g/ml, $t_n$ is the period of the n-th stage of flame-resisting treatment, and k is the number of flame-resisting treatment stages; and then carbonizing the treated fibers in an inert atmosphere.

2. The process for producing carbon fibers as set forth in claim 1, wherein the number of furnace stages is at least 3.

3. The process for producing carbon fibers as set forth in claim 1, wherein the period of flame-resisting treatment is at least 20 minutes and less than 90 minutes.

4. The process for producing carbon fibers as set forth in claim 3, wherein the period of flame-resisting treatment is at least 20 minutes and not more than 60 minutes.

5. The process for producing carbon fibers as set forth in claim 1, wherein the fibers are stretched with the percentage of stretch being controlled to 30% or less until the density of the fibers treated for flame-resistant reaches 1.22 g/ml, then the fibers are stretched so that the total percentage of stretch may not exceed 50%, and the flame-resisting treatment thereafter is conducted with the shrinkage of the fibers being inhibited substantially so that the fiber density after completion of the flame-resisting treatment may range from 1.34 to 1.40 g/ml.

6. The process for producing carbon fibers as set forth in claim 1, wherein the fibers treated for flame-resistance are precarbonized in an inert atmosphere under the conditions of a heat treatment starting temperature of 300°±50° C., a final heat treatment temperature of 450°±50° C., and a rate of temperature rise of 50°–300° C./min, and then the fibers are heat treated in an inert atmosphere within the temperature range of 400°–800° C.

7. The process for producing carbon fibers as set forth in claim 6, wherein the treatment period in the temperature range of 400° to 800° C. is up to 3 minutes.

8. The process for producing carbon fibers as set forth in claim 7, wherein the treatment period is from 0.1 to 1 minute.

9. The process for producing carbon fibers as set forth in claim 1, wherein the fibers treated for flame-resistant are treated under tension in an inert atmosphere at temperatures of 300° to 500° C., then heat-treated in an inert atmosphere at temperatures of 500° to 800° C. while being stretched at a percentage of stretch of 0 to 10%, and are subjected to carbonizing treatment at temperatures of 1300° to 1800° C.

10. The process for producing carbon fibers as set forth in claim 1, wherein the fibers treated for flame-resistance are heat-treated in an inert atmosphere by using a low-temperature heat treating furnace kept at a temperature ranging from 300° to 800° C. and are then heat-treated in an inert atmosphere by using a high-temperature heat treating furnace in which the heat treatment starting temperature is from 1000° to 1300° C., the maximum heat treatment temperature is from 1350° to 1900° C., the maximum temperature zone is positioned on the fiber exit side of the middle part of the furnace, and the gradient of temperature ranging from the heat treatment starting temperature to the maximum heat treatment temperature is a gentle slope.

* * * * *